United States Patent [19]

Ingeström

[11] Patent Number: 4,867,377

[45] Date of Patent: Sep. 19, 1989

[54] METHOD OF CONTROLLING THE CONDITIONS IN A DWELLING-HOUSE

[76] Inventor: Curt H. Ingeström, Fornminnesvägen 5, Älvängen S-446 00, Sweden

[21] Appl. No.: 241,763

[22] Filed: Sep. 7, 1988

Related U.S. Application Data

[63] Continuation of Ser. No. 73,858, Jul. 15, 1987, abandoned, which is a continuation of Ser. No. 920,919, Oct. 21, 1986, abandoned, which is a continuation of Ser. No. 776,144, filed as PCT SE84/00436 on Dec. 20, 1984, published as WO85/02877 on Jul. 4, 1985, abandoned.

[30] Foreign Application Priority Data

Dec. 28, 1983 [SE] Sweden ..... 8307187

[51] Int. Cl.[4] ..... F24D 5/10

[52] U.S. Cl. ..... 237/69; 126/431

[58] Field of Search ..... 126/430, 431, 436; 237/69, 2 B, 81

[56] References Cited

U.S. PATENT DOCUMENTS

| | | | |
|---|---|---|---|
| 2,371,396 | 3/1945 | Knowles | 237/69 |
| 2,784,945 | 3/1957 | Fodor | 237/69 |
| 2,917,240 | 12/1959 | Schwarzmayr | 237/69 |
| 4,127,973 | 12/1978 | Kachadorian | 126/431 |
| 4,269,170 | 5/1981 | Guerra | 126/430 |
| 4,270,596 | 6/1981 | Zinn et al. | 126/431 |
| 4,280,480 | 7/1981 | Raposo | 126/430 |
| 4,299,270 | 11/1981 | McGrath | 126/430 |
| 4,321,962 | 3/1982 | Doty | 126/436 |
| 4,425,906 | 1/1984 | Ingestrom | 126/431 |
| 4,440,343 | 4/1984 | Bergeron, Jr. | 237/69 |

FOREIGN PATENT DOCUMENTS

| | | |
|---|---|---|
| C 112019 | 1/1899 | Fed. Rep. of Germany . |
| B811658 | 8/1984 | Norway . |
| 76128438 | 10/1980 | Sweden . |
| 80081201 | 1/1984 | Sweden . |

*Primary Examiner*—Henry C. Yuen

*Attorney, Agent, or Firm*—Merchant, Gould, Smith, Edell, Welter & Schmidt

[57] ABSTRACT

A method and arrangement for controlling conditions of a dwelling-house is provided. The arrangement concerns the utilization of an insulated bottom slab having heat-circulating means therein. The insulation is arranged such that upon heating, moisture is driven outwardly from the bottom slab and toward the cool, underlying ground. Moisture is generally inhibited from being driven upwardly into the dwelling-house basement area. Insulation means along an outer edge of the bottom slab prevents moisture from seeping back into the bottom slab.

2 Claims, 1 Drawing Sheet

METHOD OF CONTROLLING THE CONDITIONS IN A DWELLING-HOUSE

Figure 1:
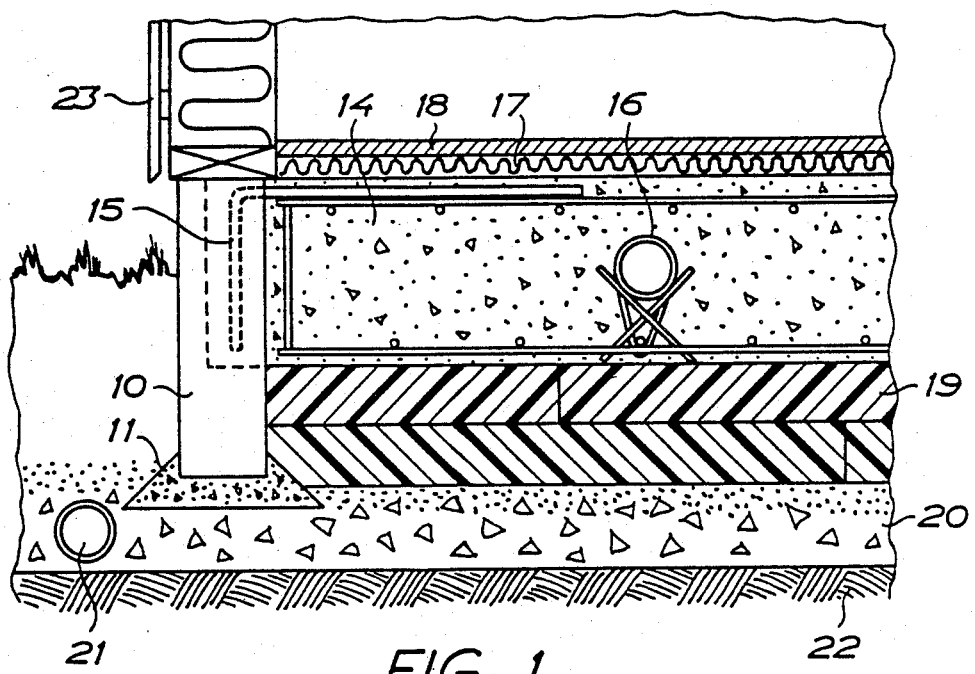

This is a continuation of application Ser. No. 073,858 filed July 15, 1987, now abandoned; which is a continuation of application Ser. No. 920,919, filed October 21, 1986, now abandoned; which is a continuation of application Ser. No. 776,144 filed as PCT SE84/00436 on Dec. 20, 1984, published as WO85/02877 on Jul. 4, 1985, now abandoned.

The invention relates to a method of controlling the conditions in a dwelling-house.

The high energy costs have raised a demand for low-energy dwelling-houses. One measure of the efforts in providing low-energy dwelling-houses is that the houses have been made as tight as possible in order to eliminate draft which otherwise is responsible for a great part of the energy consumption during the cold season. However, when a house is made practically completely tight, moisture is largely prevented from escaping from the house. It follows in many cases that the energy problem is replaced by a severe moisture problem. The moisture trapped in the house causes decomposition of existing wood structures in the house and is an excellent breeding ground for mould funguses which are spread to wall-to-wall carpets, furniture, clothes and other textiles in the house where they cause an unpleasant and annoying smell. The existence of mould in a dwelling-house in turn may cause allergies and other diseases of the people dwelling and living in the house, and also may attract insects living on the mould funguses. In other words, the conditions in the house will not be acceptable to people living in the house.

The most common remedy for moisture and mould in dwelling-houses is to see to it that there is a satisfactory drainage around the house and that the house is insulated against penetration of moisture from the outside, ventilation of the spaces where mould is present at the same time being provided. Said latter measure is, of course, a charge to the energy account. However, these measures do not provide the intended effect in all cases, because moisture may be trapped in the building structure without the possibility to escape therefrom and without being available for rehabilitation steps.

The purpose of the invention is to provide such a control of the conditions in the dwelling spaces of a dwelling-house that the conditions are not injurious to health due to the existence of moisture or mould, the requirement of low-energy consumption at the same time being satisfied. The invention is based on the principle of low-energy heating of a dwelling-house, which is described in the international application with publication No. W081/02775. In the method of the invention for controlling the conditions in a dwelling-house heating air is thus circulated in a closed system through a heat-accumulating bottom slab in the house while supplying heat to the bottom slab or taking up heat therefrom, the heat supply from the bottom slab being directed towards the dwelling spaces by proper heat insulation on the upper and lower sides of the bottom slab.

In order to achieve the purpose mentioned above the method of the invention has obtained the characteristics appearing from claim 1.

Figure 2:
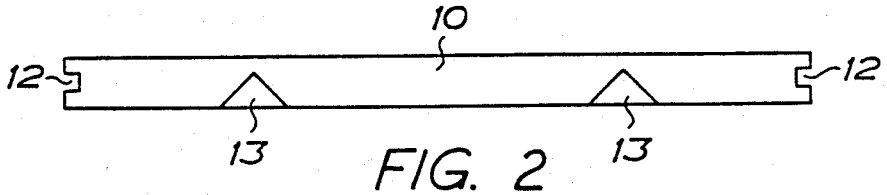
Figure 3:
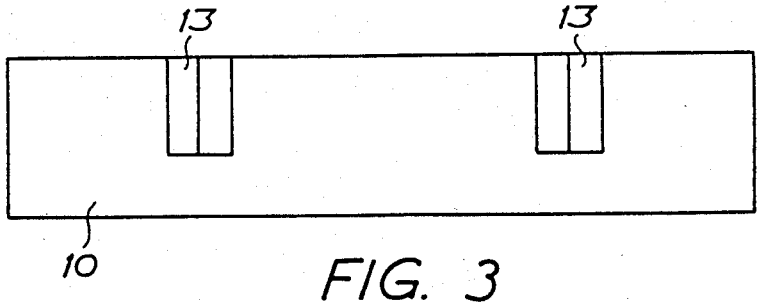

In order to explain the invention in more detail reference is made to the accompanying drawing in which FIG. 1 is a fragmentary vertical sectional view of the basement of a dwelling-house for working the method of the invention, FIG. 2 is a plan view of a building element forming part of the basement structure, and FIG. 3 is a side view of the building element of FIG. 2.

The dwelling-house fragmentarily shown in FIG. 1 has a basement which comprises building elements 10 which are set in cement mortar 11. The building elements are made of foamed polyurethane with a surface material of cement-based panel and are constructed as shown in FIGS. 2 and 3. At each end edge thereof the building element has a groove 12 to be connected to an adjacent identical building element by means of a rib. At one side of the building element there are provided two recesses 13 having triangular cross-sectional form, which open into the upper edge surface and extend downwards through the building element over substantially half the height thereof. The basement including building elements according to FIGS. 2 and 3 functions as a mould for moulding a bottom slab 14 of reinforced construction concrete. The bottom slab extends into the recesses 13 wherein it is anchored by means of reinforcing irons 15. In the bottom slab there is provided a passage system 16 which can be obtained e.g. by positioning metal tubes in the concrete. On top of the bottom slab 14 a relatively thin layer 17 of heat-insulating material is arranged, and on top of this layer a floor material 18, such as particle board, parquet, or similar material is arranged. Below the bottom slab there are one or several layers 19 of heat-insulating material. Below the heat-insulating layer or layers, a drainage layer 20 with drainage pipes 21 therein, is arranged and this layer is positioned on intact or compacted ground 22. A wide wall 23 of an arbitrary construction is supported on top of the basement including the building elements 10. The basement structure of the dwelling-house described is substantially in agreement with the disclosure of the international application mentioned above and having the publication No. W081/02775, and it is also the intention that heat shall be supplied to the bottom slab 14 such that the bottom slab functions as a heat magazine, and that the insulating layers 17 and 19 shall be dimensioned in relation to each other such that the heat supply from the bottom slab 14 is directed upwards into the dwelling spaces of the house. The heating of the bottom slab 14 and also the recovery of heat stored therein is effected by circulating air in a closed circuit through the passage system 16, the circulating air for heating being allowed to pass through a sun collector, a heat pump, a furnace, an electric heater, or a heater of any other kind.

The construction concrete of the bottom slab 14 provided as a heat magazine, can comprise conventional concrete, but an additive may be included therein, e.g. an agent forming air voids therein retarding the heat delivery from the bottom slab. The reinforcement of the bottom slab can be made very simple, but since the bottom slab is relatively thick it may also be inforced by means of beams, e.g. in such cases as piling has to take place. The bottom slab can function as a heat magazine at low temperatures, and in that case the passage system 16 should be located substantially centrally of the height of the bottom slab and should be arranged in such manner that the heat when stored into the bottom slab will be distributed substantially uniformly in the entire slab.

In addition to the function of the basement including the building elements 10, as a mould in moulding the bottom slab 14 the basement also functions as a provisional load support for the wall structure 23 erected on the basement, until a vault effect is obtained in the bottom slab 14 connected to the basement, all load support then being effected over the bottom slab.

The insulating layer or layers 19 should be pervious so that a fluid can pass therethrough. The layer or layers can comprise e.g. SUNDOLIT or STYROLIT (registered trademarks) consisting of polystyrene granules with external voids, i.e. open voids or passages between adjacent granules. This means that moisture can pass from the bottom slab 14 through the insulating layer or layers 19 downwards into the drainage layer 20 and the ground 22. Therefore, when the basement is built up and immediately after moulding of the bottom slab 14, hot air can be circulated through the passage system 16 to dry the bottom slab, the moisture being driven downwards through the layer or layers 19 to the underlying ground. The heat storage in the bottom slab and the drying of the bottom slab thus can take place immediately after moulding, and if the house is built during the cold season, the cement binding can be accelerated by this procedure. Thus, the basement will be warm and dry before the house is built from the basement, which means that the building moisture problems are eliminated and no freezing of the ground below the bottom slab can take place. The building elements 10 function as a moisture barrier at the edge surfaces of the bottom slab 14, and therefore the moisture in the bottom slab which is driven from hotter areas to colder areas, will be driven down into the ground below the bottom slab and moisture will be effectively prevented from penetrating into the house from below. There is obtained a temperature gradient in the basement structure securing that the dew point and thus the moisture precipitation will be located at the underlying ground 22 or possibly to the surface thereof. However, no moisture precipitation will take place in the basement structure proper and as a consequence thereof the existence of moisture and mould in the portions of the house which are in contact with the basement structure, is eliminated.

If the air circulating in the passage system 16 is allowed temporarily at uniform intervals to reach a high temperature, e.g. about 150° C., which can be controlled by means of proper electronic apparatus, the passage system will be sterilized. Since the circulation system, moreover, is a closed circulation system, spores and bacteria cannot be supplied to the passage system from the outside, which all guarantees that there is no breeding ground whatsoever for funguses and bacteria in the passage system.

The temperature of the heat magazine formed by the bottom slab 14 can vary between e.g. 22° C. and 37° C. Then, the insulation layer 17 should be calculated such that there is obtained a maximum temperature at the surface of the floor material 18 of 21.5° C. However, if it is desired to have a higher surface temperature of the floor, e.g. about 25° C., as in a bathroom, the thickness of the insulating layer 17 should be made smaller. The purpose of this insulating layer is above all to retard the heat supply from the bottom slab 14 and to provide a uniform temperature distribution on the floor surfaces.

By a dwelling space being heated in the manner described, i.e. by controlled heat supply from a bottom slab arranged as a heat magazine, the differences between the surface temperatures of floor, walls and ceiling will be at minimum, and as a consequence thereof there will be no significant redistribution of positive and negative ions in the space and thus no static electricity, which is contrary to heating of houses having a common "cold" basement structure and radiators wherein the temperature differences of the surfaces can be of the order of 50° C. Consequently, the collection of dust will be reduced, because the dust particles have no tendency of combining to larger aggregates in the absence of static electricity.

Within the scope of the invention this can be applied also to other house constructions than that described herein in order to illustrate the invention.

I claim:

1. An improved foundation arrangement providing for selective control of moisture and temperature related conditions of a dwelling-house built thereon; said arrangement comprising:

(a) a bottom slab portion having upper and lower surfaces and a side edge and being reinforced with irons;

(b) a closed heat-radiating air circulation system imbedded within said bottom slab portion;

(c) a first insulating layer positioned above said bottom slab portion upper surface;

(d) a second insulating layer positioned below said bottom slab portion lower surface; said second insulating layer including voids and passages therein constructed and arranged for selected movement of moisture downwardly therethrough;

(e) edge insulation means constructed and arranged to provide substantial heat and moisture insulation along said slab portion side edge and along edge portions of said first and second insulating layers; said edge insulating means being provides with recesses for receiving said reinforcing irons and defining a wall oriented along, and outside of, said slab portion side edge;

(f) whereby said heat-radiating circulating system may be selectively actuated to substantially dry said bottom slab portion by driving moisture therein through said second insulating layer and toward ground thereunder, while simultaneously heating said bottom slab portion.

2. A method of controlling moisture and temperature related conditions in a foundation portion of a dwelling-house, said method comprising the steps:

(a) providing a first insulating layer; said insulation layer including voids and passages therein and constructed and arranged for selected movement of moisture downwardly therethrough;

(b) providing a heat and moisture insulation building element along side edge portions of said first insulating layers; the building elements having a vertical extension greater than said first insulating layer;

(c) using said first insulating layer and said building element as a mold when molding a bottom slab portion in the foundation; the bottom slab portion having upper and lower surfaces and a side edge;

(d) providing a closed heat-radiating air circulation system imbedded within said bottom slab portion;

(e) providing a second insulating layer above said bottom slab portion upper surface; and (f) selectively providing heat to said bottom slab portion through said heat-radiating circulation system; said heat driving moisture in said bottom slab portion downwardly through said first insulating layer and toward ground thereunder.

* * * * *